US006041688A

United States Patent [19]

Woznica et al.

[11] Patent Number: 6,041,688

[45] **Date of Patent: *Mar. 28, 2000**

[54] WIRELESS GUIDED MISSILE LAUNCH CONTAINER

[75] Inventors: M. Woznica; R. T. Cock, both of Tucson, Ariz.

[73] Assignee: Raytheon Company, Lexington, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/668,664

[22] Filed: Jun. 25, 1996

[51] Int. Cl.[7] ..... F41F 3/045; F41G 7/30

[52] U.S. Cl. ..... 89/1.816; 89/6.5; 244/3.14

[58] Field of Search ..... 89/6.5, 1.56, 1.55, 89/1.816, 6; 244/3.14, 3.12; 235/408

[56] References Cited

U.S. PATENT DOCUMENTS

| | | | |
|---|---|---|---|
| 2,555,384 | 6/1951 | Watt | 89/6.5 |
| 2,603,970 | 7/1952 | Metzler et al. | 89/6.5 |
| 4,022,102 | 5/1977 | Ettel | 89/6.5 |
| 4,137,819 | 2/1979 | Loomis, III | 89/1.813 |
| 4,142,442 | 3/1979 | Tuten | 89/6.5 |
| 4,144,815 | 3/1979 | Cumming et al. | 102/214 |
| 4,214,534 | 7/1980 | Richter et al. | 102/215 |
| 4,586,421 | 5/1986 | Hickey et al. | 89/1.81 |
| 4,649,796 | 3/1987 | Schmidt | 89/6.5 |
| 4,664,013 | 5/1987 | Wegner et al. | 89/6.5 |
| 4,678,142 | 7/1987 | Hirschfeld | 244/3.16 |
| 4,816,836 | 3/1989 | Lalezari | 342/62 |
| 5,117,731 | 6/1992 | Mendenhall | 89/1.816 |
| 5,233,901 | 8/1993 | Nilsson et al. | 89/6.5 |
| 5,362,014 | 11/1994 | Sandham | 244/3.12 |
| 5,390,581 | 2/1995 | Hiltz et al. | 89/1.812 |
| 5,458,042 | 10/1995 | Cante | 89/6.5 |
| 5,493,627 | 2/1996 | Pan et al. | 385/111 |
| 5,564,649 | 10/1996 | Von Hoessle et al. | 244/3.12 |

*Primary Examiner*—Charles T. Jordan
*Assistant Examiner*—Christopher K. Montgomery
*Attorney, Agent, or Firm*—David W. Collins; Leonard A. Alkov; Glenn H. Lenzen, Jr.

[57] ABSTRACT

An improved missile launch tube design (10) for wireless TOW missiles. The inventive launch tube (10) includes electronic circuitry (30) for missile guidance and an antenna (40) mounted within a protective casing (12). In a particular embodiment, the electronic circuit (30) includes a radio frequency encoder and transmitter and the antenna (40) is a radio frequency antenna mounted in a spacer ring (20) disposed at the first end (14) of the tube (10).

9 Claims, 3 Drawing Sheets

WIRELESS GUIDED MISSILE LAUNCH CONTAINER

BACKGROUND OF THE INVENTION

1. Field of the Invention

The present invention relates generally to Tube Launched Optically Tracked Wireguided (TOW) missiles. More specifically, the present invention relates to launch tubes for next generation wireless TOW missiles.

2. Description of the Related Art

Tube Launched Optically Tracked Wireguided (TOW) missiles are well known in the art. TOW missiles are generally mounted within a canister or launch container which, in turn, is mounted within a launcher. A gunner locates a target in the crosshairs of a sight and launches the missile from the launch tube. If the sight is kept on the target, the missile is guided to the target via wires which uncoil from the aft end thereof. Next generation TOW missiles may have a fire and forget or command line of site in which the missile may be guided thereto by a radio frequency transmitter.

In any event, upgrades in missile technology may require an upgrade in the launch system. Conventionally, the guidance and control electronics are located in the launcher with little or no processing circuitry being in the launch tube. As a result, an upgrade in the missile and/or the missile launcher may require an upgrade or replacement of the launcher. As the launchers are generally expensive, there is a need in the art for an inexpensive alternative technique for launching missiles that allows for inexpensive upgrades thereof.

SUMMARY OF THE INVENTION

The need in the art is addressed by the present invention which provides an improved missile launch tube design for wireless TOW missiles. The inventive launch tube includes electronic circuitry for missile guidance commands and an antenna mounted within a protective casing. In a particular embodiment, the electronic circuit includes a radio frequency encoder and transmitter and the antenna is a radio frequency antenna mounted in a spacer ring disposed at the first end of the tube.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
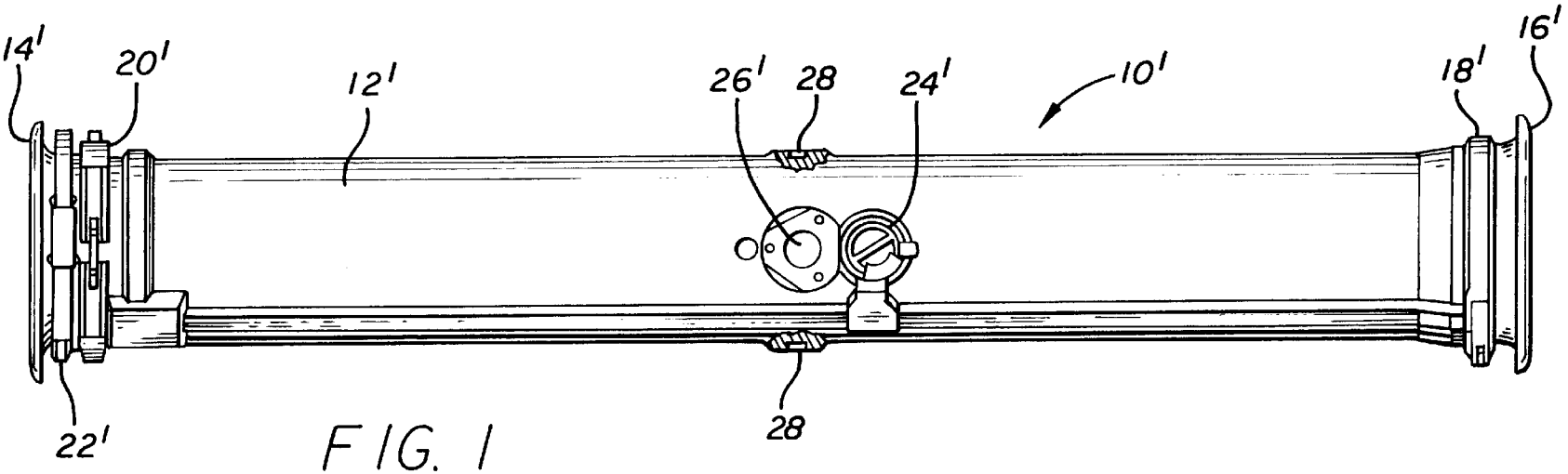
FIG. 1 PRIOR ART
FIG. 1 is a top view of a conventional TOW missile launch tube.

FIG. 1 is a top view of a conventional TOW missile launch tube.

Figure 2:
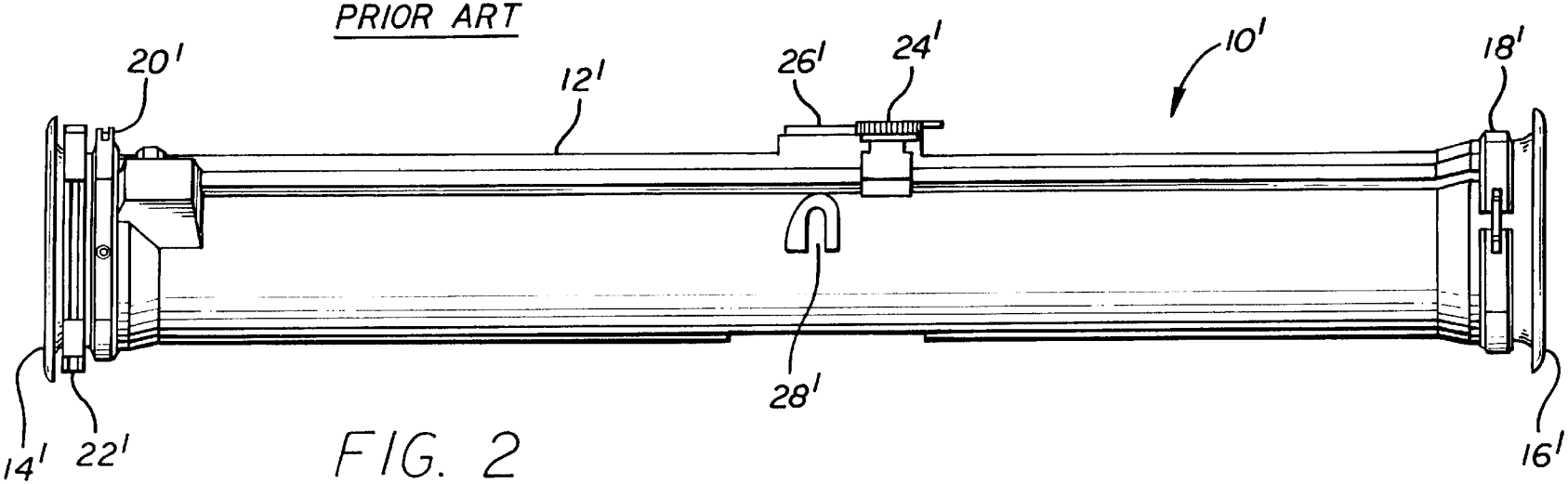
FIG. 2 PRIOR ART
FIG. 2 is a side view of the conventional TOW missile launch tube of FIG. 1.

FIG. 2 is a side view of the conventional TOW missile launch tube of FIG. 1. As shown in FIGS. 1 and 2, the conventional TOW launch tube 10' includes a cylindrical canister 12' constructed of fiber reinforced resin or other suitable material. The canister 12' has a typical uniform diameter of 6.350 inches along the length axis thereof The tube 10' has a fore end 14' and an aft end 16'. A spacer ring 20' is mounted at the fore end 14' of the tube 10'. The spacer ring 20' provides a forward environmental seal. Additional mounting hardware is mounted at the aft end 18' and the fore end 22' of the launch tube 10' and includes shock rings for missile protection. An electrical connector 24' and a hold-back pin 26' are mounted in the midsection of the tube 10'. As shown in FIG. 2, the tube 10' includes a full radius launcher ready attachment surface 28'.

The conventional launch tube 10' of FIGS. 1 and 2 is adapted for use with a missile launcher in which guidance and control electronics are located. Accordingly, no provision is made for guidance and control circuitry in the launch tube 10'. However, as mentioned above, upgrades in the design of TOW missiles often necessitate upgrades in the guidance and control electronics. This requires an expensive upgrade of the launcher. The launch tube of the present invention is designed to provide for storage of command and communication electronics allowing for inexpensive upgrades of the missile by simply upgrading the command and communication circuitry stored in the associated launch tube as opposed to the launcher. Further, the inventive launch tube provides an antenna for radio frequency guided missiles.

Figure 3:
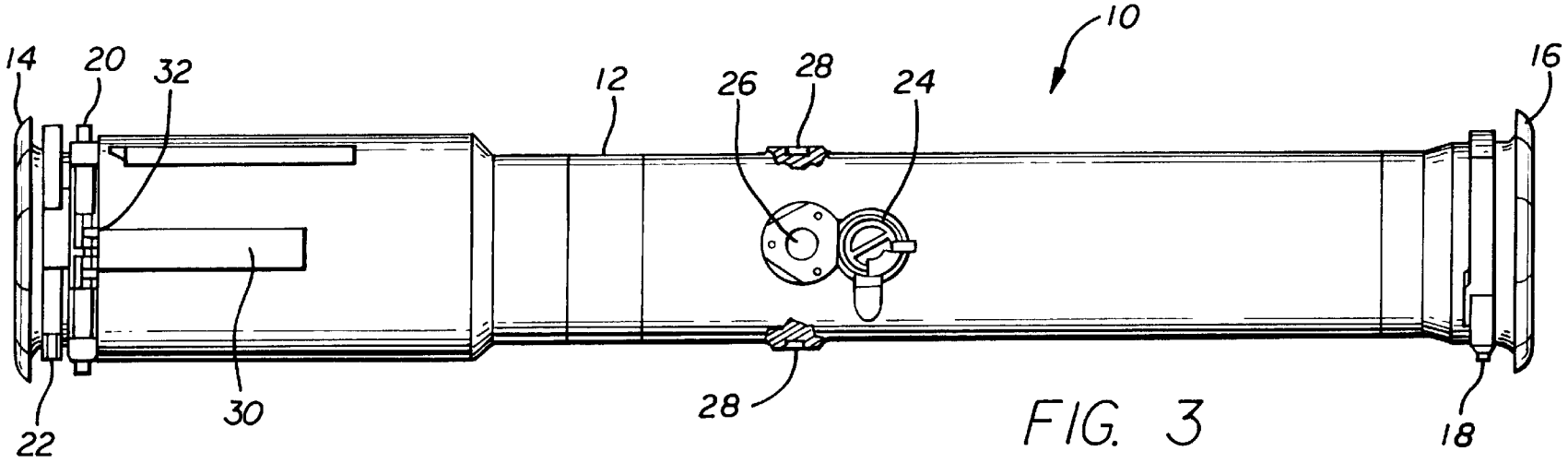
FIG. 3 is a top view of the missile launch tube of the present invention.

FIG. 3 is a top view of the missile launch tube of the present invention.

Figure 4:
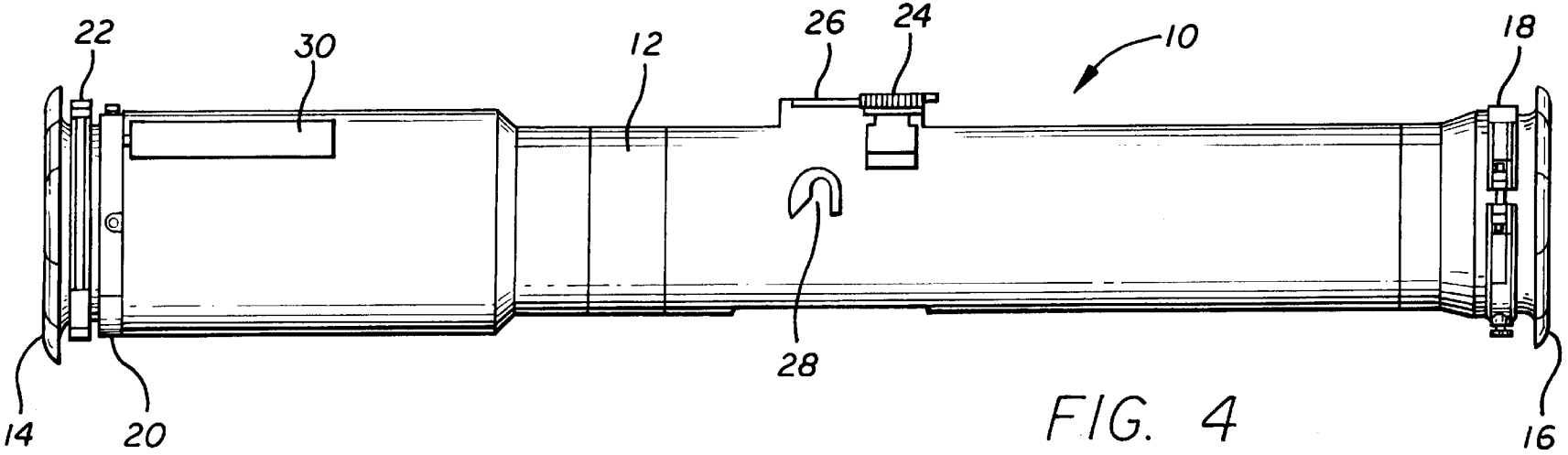
FIG. 4 is a side view of the missile launch tube of the present invention.

FIG. 4 is a side view of the missile launch tube of the present invention. As shown in FIGS. 3 and 4, the inventive launch tube 10 is similar in construction to the conventional tube 10' in that it includes a cylindrical canister 12 constructed of graphite or other suitable material. The tube 10 has a fore end 14 and an aft end 16. Note that at the fore end 14 of the inventive tube 10, the canister 12 has an expanded outside diameter (on the order of 7.400 inches) to accommodate an electronic circuit and interconnection pathways. The electronic circuit 30 includes a radio frequency encoder and a radio frequency transmitter of conventional design, along with additional electronics.

Figure 5:
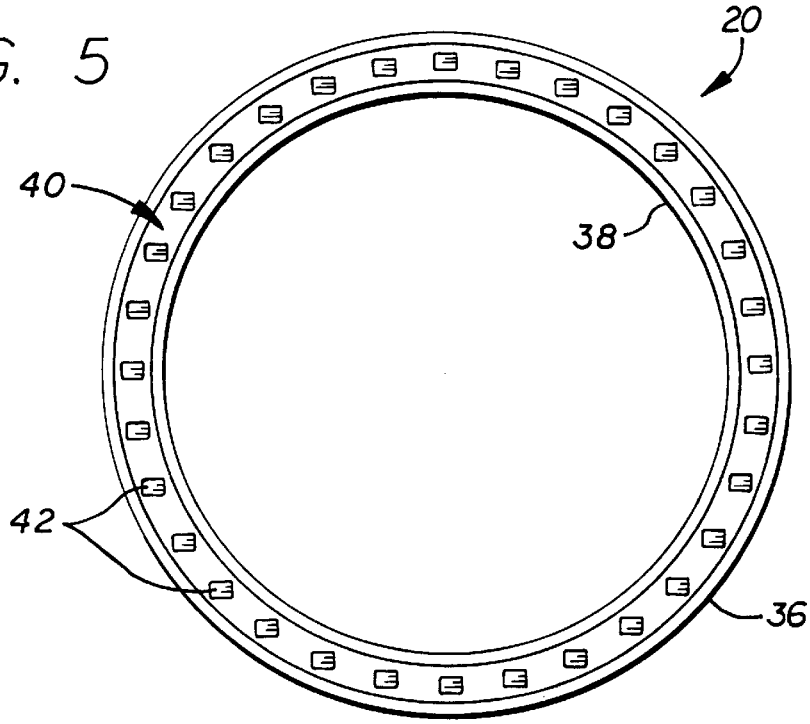
FIG. 5 is an end view of the missile launch tube of the present invention.

A spacer ring 20 is mounted at the fore end 14 of the tube 10. As shown in the end view of FIG. 5, the spacer ring 20 includes an outer wall 36 and an inner wall 38 and a dielectric ring 39 therebetween. The dielectric ring 39 may be a fiberglass/epoxy resin, PTFE or other suitable material. A particularly novel aspect of the present invention is the provision of a radio frequency antenna 40 within the ring 20. The antenna 40 is designed to provide a coverage area suitable to guide a missile along its entire anticipated flight path.

Figure 6:
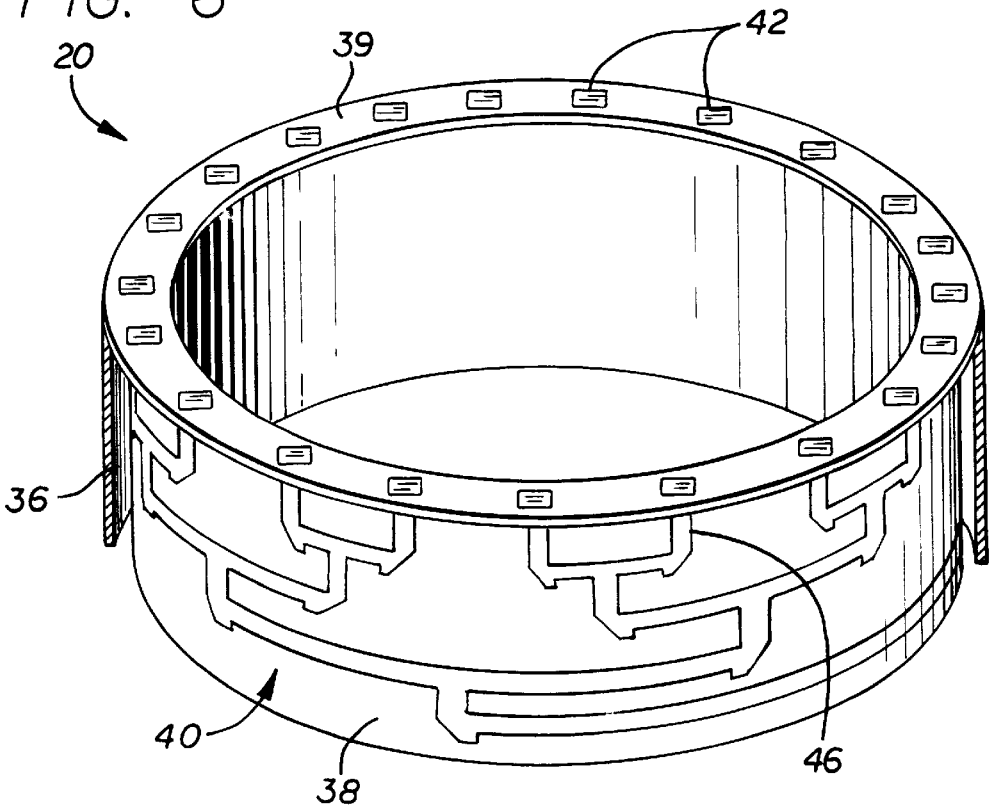
FIG. 6 is a perspective view of the spacer ring employed in the missile launch tube of the present invention.

FIG. 6 is a perspective view of the spacer ring 20 and antenna 40 employed in the missile launch tube 10 of the present invention. In the illustrative embodiment, the antenna 40 includes a plurality of linearly polarized or circularly polarized copper microstrip patch radiating elements 42 connected by a copper stripline feed network 46 disposed on a surface of the inner wall 38. In the illustrative embodiment, the antenna 40 comprises eight patch radiating elements 42 per quadrant for a total of 32 elements. The interconnects between the feed 46 and each element 42 are 'all angle' transitions since power is transitioned equally to all elements of the antenna 40. Those skilled in the art will appreciate that other antenna designs using other feed types may be used without departing from the scope of the present teachings.

The antenna 40 is connected to the electronic circuit 30 via an embedded connection path and includes a coaxial feed (not shown). Electrical connection of the electronic circuit 30 to a missile is effected by a conventional TOW missile umbilical connector. An internal waveguide type transmission strip (not shown) is embedded on the inner diameter of the tube 10 to allow a path for the transmission of signals to a receiver located at the aft end of the missile while the missile resides in the missile launch tube.

Returning to FIGS. 3 and 4, as with the conventional launch tube 10', additional mounting hardware 22 is mounted at the fore end of the launch tube 10 and includes a shock collar and seal for missile protection. Aft end mounting hardware 18 includes a seal and shock collar. An electrical connector 24 and a holdback pin 26 are mounted in the midsection of the tube 10. As shown in FIG. 4, the tube 10 includes a full radius launcher ready attachment surface 28.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention. Accordingly,

What is claimed is:

1. A missile launch tube comprising:

a tube adapted to retain a tube launched, optically tracked, wire guided type missile, and having a forward end and a back end;

an electronic circuit mounted within said tube; and an antenna connected to said circuit and mounted at the forward end of said tube, said antenna comprising a plurality of copper microstrip patch radiating elements connected by a copper stripline feed network disposed on a surface of a wall of said tube.

2. The invention of claim 1, further including means for mounting said electronic circuit within said tube.

3. The invention of claim 1, wherein said electronic circuit includes a radio frequency transmitter.

4. The invention of claim 3, wherein said electronic circuit includes a radio frequency encoder.

5. The invention of claim 1, wherein said antenna is mounted in a spacer ring disposed at said forward end of said tube.

6. The invention of claim 5, wherein said antenna is a radio frequency antenna.

7. A missile launch tube comprising:

a tube adapted to retain a wireless tube launched, optically tracked, wire guided missile;

an electronic circuit mounted within said tube including a radio frequency transmitter; and a radio frequency antenna mounted in a spacer ring disposed at a first end of said tube and electrically connected to said transmitter, said antenna comprising a plurality of copper microstrip patch radiating elements connected by a stripline feed network.

8. The invention of claim 7, wherein said electronic circuit includes a radio frequency encoder.

9. A missile launch tube comprising:

a tube adapted to retain a wireless tube launched, optically tracked, wire guided missile, said tube having a forward end and a back end;

an electronic circuit mounted within said tube;

a spacer ring attached to the forward end of said tube, said spacer ring comprising an outer wall, an inner wall and a dielectric ring disposed therebetween; and an antenna connected to said circuit and mounted in said spacer ring, said antenna comprising a plurality of copper microstrip patch radiating elements connected by a copper stripline feed network disposed on a surface of a wall of said tube.

* * * * *